US006142365A

United States Patent [19]

Breitbach

[11] Patent Number: 6,142,365

[45] Date of Patent: Nov. 7, 2000

[54] FOLDABLE PLASTIC BOX

[76] Inventor: William Breitbach, 1525 Flower St., Glendale, Calif. 91201

[21] Appl. No.: 09/226,290

[22] Filed: Jan. 7, 1999

[51] Int. Cl.[7] ..... B65D 5/20; B26D 5/42

[52] U.S. Cl. ..... 229/198.2; 229/195; 220/7; 220/689; 220/691

[58] Field of Search ..... 229/197, 198.2, 229/195, 190, 194; 220/6, 7, 689, 690, 691; 24/588, 700, 702

[56] References Cited

U.S. PATENT DOCUMENTS

| | | | |
|---|---|---|---|
| 922,334 | 5/1909 | Regenstein | 229/190 X |
| 3,360,180 | 12/1967 | Venturi | 220/7 |
| 3,424,365 | 1/1969 | Venturi | 229/198.2 X |
| 3,927,921 | 12/1975 | Dunning | 229/198.2 X |
| 4,005,795 | 2/1977 | Mikkelsen et al. | 220/7 |
| 4,757,909 | 7/1988 | Matsuura | 220/7 X |
| 4,978,020 | 12/1990 | Aono | 220/7 |
| 5,195,644 | 3/1993 | Schmid | 220/6 |
| 5,501,354 | 3/1996 | Stromberg | 220/7 |

*Primary Examiner*—Stephen P. Garbe
*Assistant Examiner*—Tri M. Mai
*Attorney, Agent, or Firm*—Christie, Parker & Hale, LLP

[57] ABSTRACT

A unitary, foldable plastic box. The box has a bottom wall with a perimeter and at least three perimeter walls hingeably affixed to the perimeter of bottom wall with living hinges. A first attachment mechanism and second attachment mechanism complementary to the first attachment mechanism are provided on the perimeter walls. The first attachment mechanism has a tab with a protrusion, and the tab extends from at least one side edge of at least one perimeter wall. The second attachment mechanism has a relief and aperture formed in at least one perimeter wall. The relief and aperture are sized to engage the tab and protrusion of the first attachment mechanism. When the perimeter walls are brought together, the first attachment mechanism and second attachment mechanism can be detachably engaged together to form a box.

7 Claims, 6 Drawing Sheets

FIG. 1
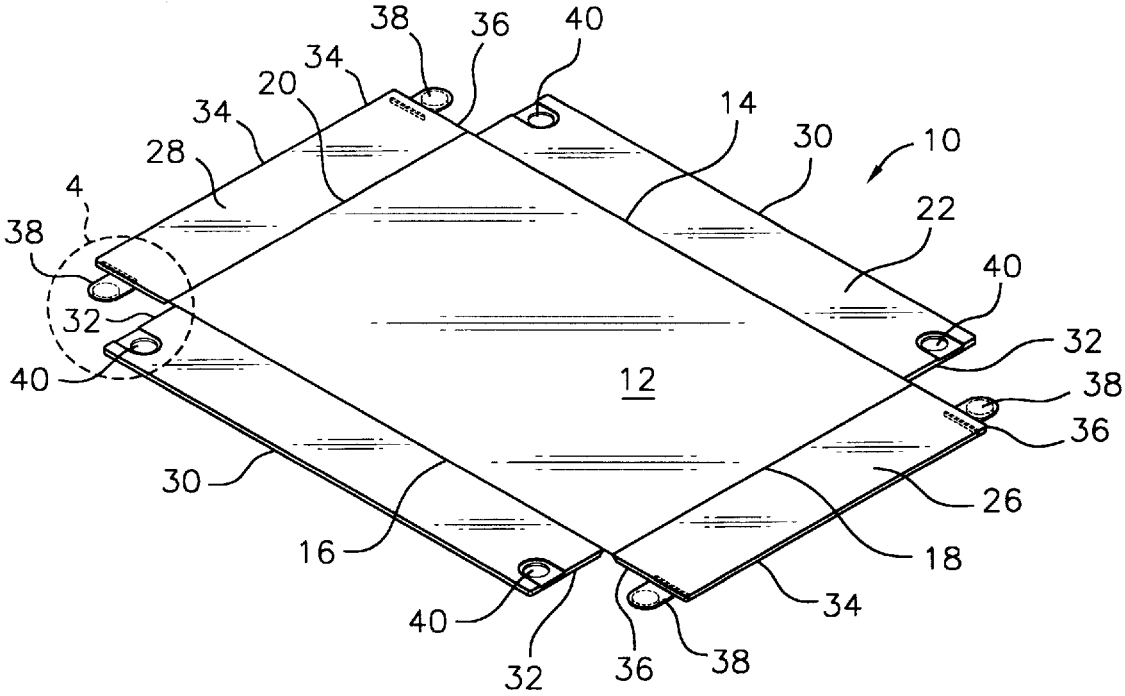
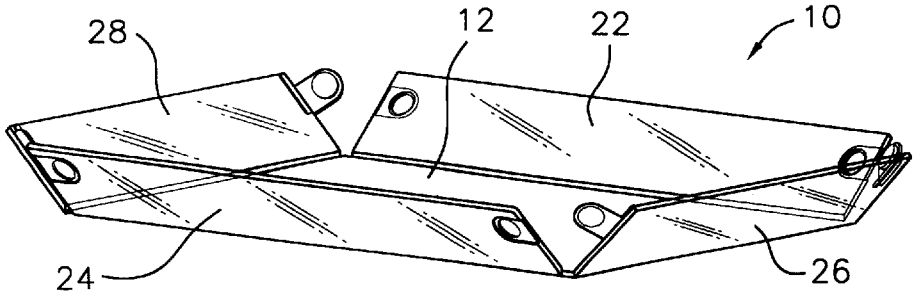
FIG. 2

FOLDABLE PLASTIC BOX

BACKGROUND OF THE INVENTION

1. Field Of The Invention

The invention relates to the field of boxes, and more particularly to foldable plastic boxes that are generally flat in their unfolded condition, and which can be set up quickly and easily without adhesives, glues, or otherwise, and which can be folded and unfolded repeatedly.

2. Description Of Related Arts

Plastics boxes have numerous advantages compared to boxes made of other materials such as wood, cardboard, and/or card stock. Plastic boxes can be used for holding and storing a multitude of items, including jewelry, eye glasses, computer parts, photo supplies, craft supplies, toys, hardware supplies, automotive accessories, furniture parts, beauty and cosmetic supplies, food, pharmaceuticals, and school supplies, just to name a few. However, relatively rigid plastic boxes, except for nestable plastic boxes with downwardly and inwardly slanted sidewalls, are not foldable and therefore take more room to store and ship than comparable folding styles of cardboard boxes. In cases of travelling trade shows, for example, where displays must be broken down and repeatedly shipped, reducing the volume of items shipped is highly desirable.

Others have attempted to make plastic boxes that are in a lay-flat condition prior to being assembled. For example, U.S. Pat. No. 4,762,272 to Herrin discloses a box formed from two sections of polymeric plastic sheets. A top and bottom of the box are formed from each of the sheets of plastic material by folding up side panel, applying a separately applied liquid glue to tabs on some of the sidewalls, and permanently adhering them to adjacent sidewalls. Once assembled, the box cannot be de-assembled. One would expect that if the polymeric material were clear or translucent, the liquid glue would cause discoloration of the plastic surface.

U.S. Pat. No. 3,695,514 to Mascetti, Jr. discloses a plastic box assembled from a sheet of thermoplastic material that is heated and molded over a box-shaped mold. Once assembled, it cannot be placed back into a fold flat condition by the user.

There accordingly remains a need for foldable plastic boxes that are generally flat in their unfolded condition, and which can be set up quickly and easily without adhesives, glues, or otherwise, and which can be folded and unfolded repeatedly.

SUMMARY OF THE INVENTION

One object of the invention is to provide a foldable plastic box that is generally flat in its unfolded condition, that can be set up quickly and easily without adhesives or glues.

Another object of the invention is to provide a foldable plastic box that can be folded and unfolded repeatedly.

A further object of the invention is to provide a foldable plastic box with side walls that are generally smooth and uninterrupted when in a folded condition.

Yet another object of the invention is to provide a foldable plastic box formed from relatively rigid plastic material.

These and other objects of the invention are provided by a foldable plastic box, comprising:

a bottom wall with a perimeter;

at least three perimeter walls hingeably affixed to the perimeter of bottom wall;

a tab with a protrusion, the tab extending from at least one side edge of at least one perimeter wall, and a through hole formed in at least one perimeter wall and having a surrounding relief formed on the inner wall surface of the perimeter wall, the hole and relief being sized to engage the tab and protrusion, wherein when the perimeter walls are brought together, the hole and relief and the tab and protrusion can be engaged together to form a box.

BRIEF DESCRIPTION OF THE DRAWINGS

FIG. 1 is a top right perspective view of a first embodiment of the folding plastic box of the invention in its unfolded state.

FIG. 2 is a top right perspective view of the folding plastic box of FIG. 1 that is partially folded.

DISCUSSION OF THE PREFERRED EMBODIMENT

Figure 3:
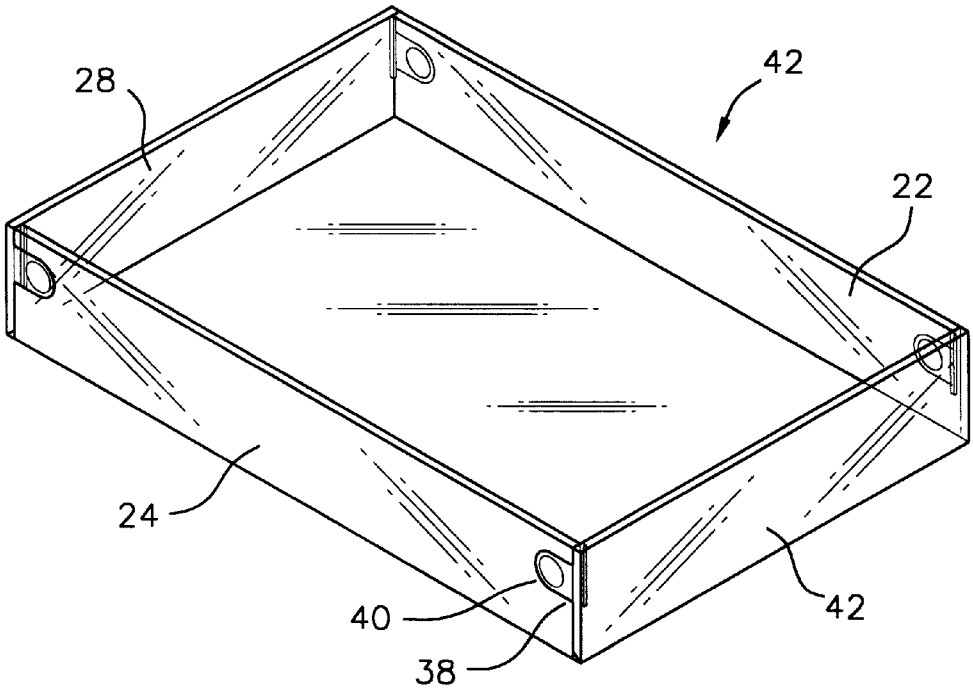
FIG. 3 is a top perspective view of the folding plastic box of FIG. 1 with its walls joined together to form the completed box.

Referring first to FIG. 1, there is shown a first embodiment of the foldable plastic box 10 of the invention in its unfolded state. The folding plastic box 10 has a bottom 12 with perimeter edges 14, 16, 18, and 20. Side walls 22 and 24 are joined to perimeter edges 14 and 16, respectively, and end walls 26 and 28 are joined to perimeter edges 18 and 20, respectively, with living hinges 66 (shown in detail with respect to FIG. 4 below.) Hereinafter, side walls 22 and 24 and end walls 26 and 28 are sometimes referred to generically as "perimeter walls". Side walls 22 and 24, and end walls 26 and 28 are preferably rectangular in shape. Side walls 22 and 24 have top edges 30 and side edges 32. End walls 26 and 28 have top edges 34 and side edges 36. First detachable attachment means 38 are positioned on end walls 26 and 28, near side edges 36 thereof, and complementary, second detachable attachment means 40 are formed on side walls 22 and 24 near side edges 32 thereof. First detachable attachment means 38 and complementary, second detachable attachment means 40 are adapted to detachably engage with each other, as will be discussed in greater detail below.

Turning to FIG. 2, the folding plastic box 10 of the invention is shown with its side walls 22 and 24 and end walls 26 and 28 being folded upwardly from bottom 12, to begin to snap box together. FIG. 3 shows the first embodiment of the folding plastic box 10 of the invention with its side walls 22 and 24 and end walls 26 and 28 brought and retained together with first detachable attachment means 38 and second detachable attachment means 40, complementary to first detachable attachment means 38, to make an open top box 42.

Figure 4:
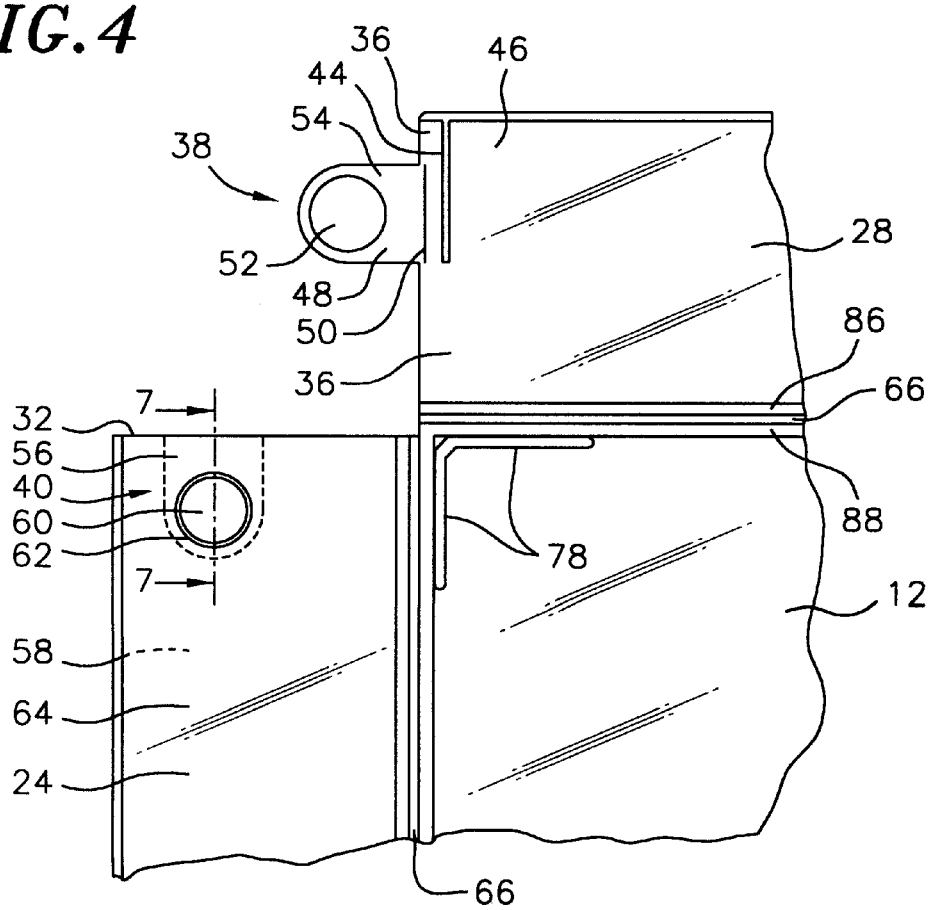
FIG. 4 is a detail showing the detachable attachment means of area 4—4 of FIG. 1.

Referring to FIG. 4, a detail of area 4—4 of FIG. 1 shows a portion of the bottom 12, end wall 28 and first detachable attachment means 38, and side wall 24 and second detachable attachment means 40, complementary to first detachable attachment means 38. End wall 28 preferably has a raised stop 44 formed on its inside surface 46 of side wall 28. First detachable attachment means 38 preferably comprises a tab 48 formed as part of end wall 28 and being connected to end walls 28 with living hinges 50 near side edges 36. A protrusion 52 is formed on inside surface 54 of tab 48. Protrusion 52 can preferably have a generally circular profile. Second detachable attachment means 40, preferably comprises a relief 56 with the same general shape and size of the outline as tab 48, but slightly larger, formed in the outside surface 58 of side wall 24 and in communication with side edge 32. An aperture 60 slightly larger than protrusion 50 is formed through side wall 24, and is surrounded by a slightly larger area of relief 62 formed on the inside surface 64 of side wall 24. As noted above, side walls 22 and 24 and end walls 26 and 28 are joined to bottom 12 near perimeter edges 14 and 16, and 18 and 20, respectively, by living hinges 66. The living hinges 66 preferably comprise thin areas of plastic material that allow side walls 22 and 24 and end walls 26 and 28 to repeatedly be flipped between the unfolded condition, as shown in FIG. 1, and the snapped together position of FIG. 3. Likewise, living hinges 50 connecting tab 48 to end walls 28 (and 26, not shown) preferably comprises thinned areas of plastic material.

Figure 5:
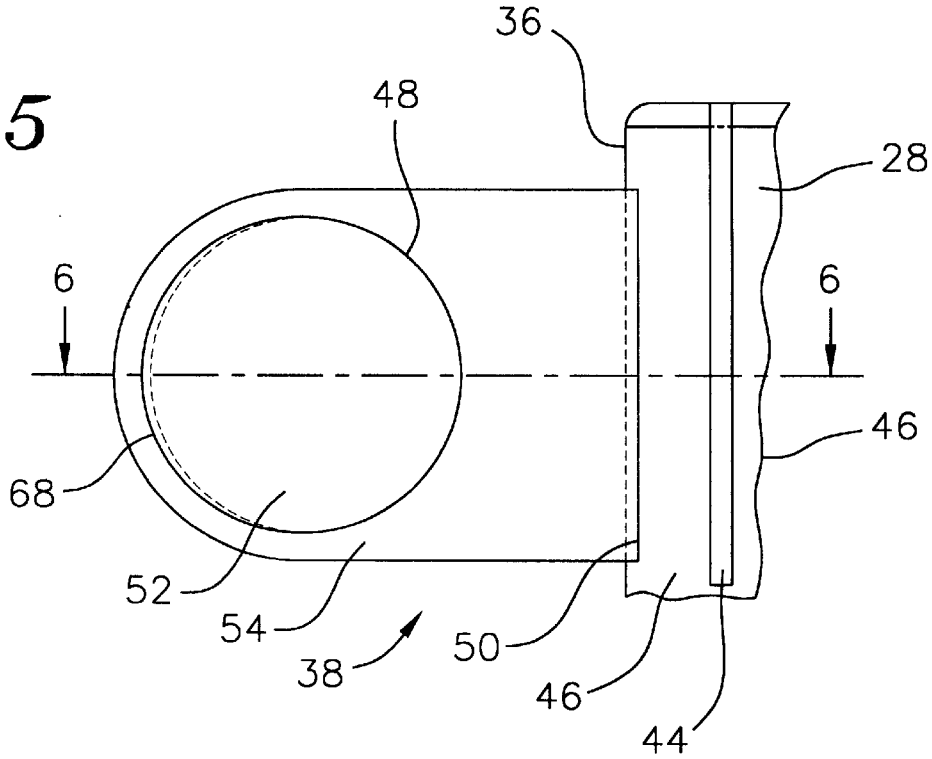
FIG. 5 is a detail top plan view showing a snap tab of FIG. 4.
Figure 6:
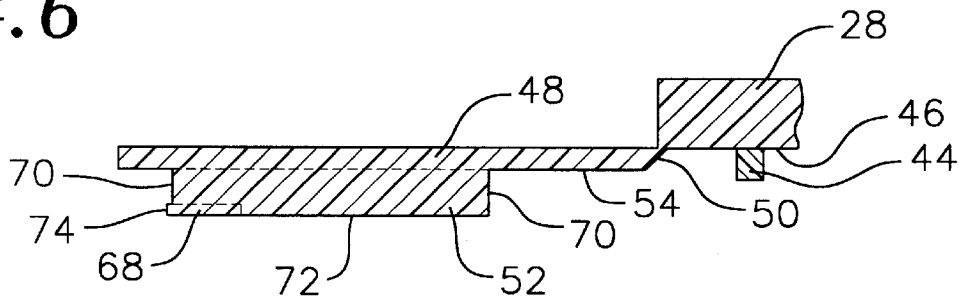
FIG. 6 is a cross-section view through view lines 6—6 of FIG. 5.
Figure 7:
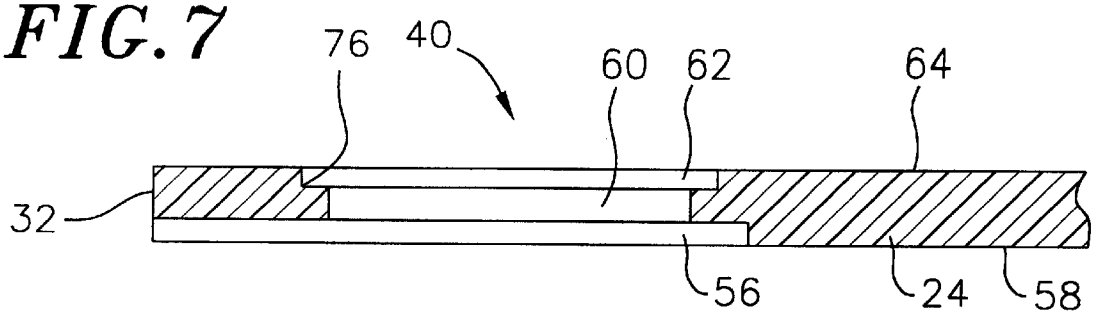
FIG. 7 is a cross-section view through view lines 7—7 of FIG. 4.

Turning to FIGS. 5 and 6, a detail of first detachable attachment means 38 is shown. As noted above, first detachable attachment means 38 preferably comprises a tab 48 formed as part of end wall 28 and being connected to end walls 28 with living hinges 50 near side edges 36. A protrusion 52 is formed on inside surface 54 of tab 48. Protrusion 52 can preferably have a generally circular profile. As can be seen in FIGS. 5 and 6, protrusion 52 has a lip region 68 formed together with protrusion 52 on at least a portion of the perimeter 70 near outer face 72 of protrusion 52. Lip region 68 is formed such that it protrudes beyond perimeter 70 of protrusion 52. Protrusion 52 has a cross-section profile that is slightly smaller than aperture 60, as shown in FIG. 7, which is a cross-section view through view lines 7—7 of FIG. 4. Protrusion 68 extends out beyond perimeter 70 and has a thickness 74 that is preferably slightly less than depth 76 of the area of relief 62 formed on the inside surface 64 of side wall 24. Relief 56 on outside surface of 58 of side wall 24 is also shown.

Figure 8:
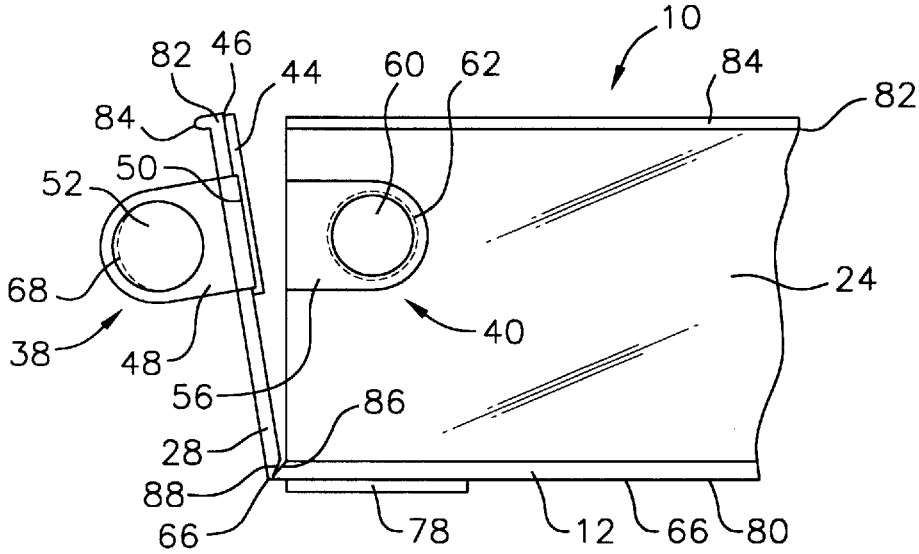
FIG. 8 is a detail front side view showing the box just prior to its side walls from being snap fitted together.
Figure 9:
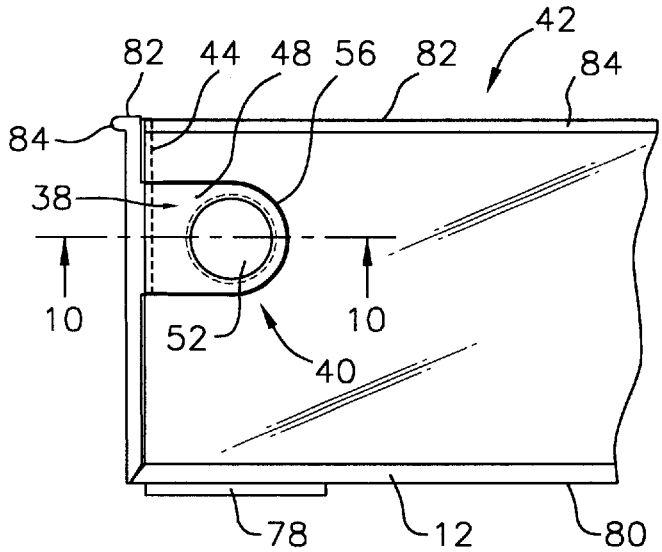
FIG. 9 is a front side view showing the box with its side walls snap fitted together.

Referring to FIG. 8, a detail showing a corner of box 42 just prior to having its end walls 28 and side walls 24 snapped together is shown. As shown, feet means 78 are preferably provided on bottom face 80 of bottom 12 of box 42. Feet means 78 not only raise bottom 12 of box 42 off of a counter surface or otherwise, but also provide means to permit multiple assembled boxes 42 to be stacked. A detail showing the same comer of the now completed and snapped together box 42 is shown in FIG. 9. As shown, at an upper edge 82 of side walls 24 (and 22, not shown) and end walls 28 (and 26, not shown), an additional rim or bead 84 of plastic can preferably be formed into wall to help wall retain a straight and unbowed profile. For further strength, additional beads can be formed on side walls 22 and 24, end walls 26 and 28, and/or bottom 12 (not shown.) Referring back to FIG. 4, so that side walls 22 and 24 and end walls 26 and 28 can be folded closely against bottom 12, the areas 86 of side walls 24 (and 22, not shown) and end walls 28 (and 26, not shown) adjacent living hinge areas 66, and areas 88 near perimeters 14, 16, 18 and 20 of bottom 12 are preferably beveled.

Figure 10:
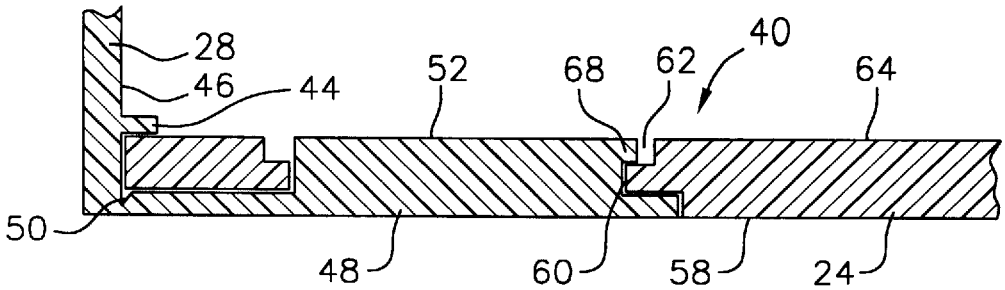
FIG. 10 is a cross-sectional view through view lines 10—10 of FIG. 9.

FIG. 10 is a cross-sectional view through view lines 10—10 of FIG. 9, and shows the interaction of the first detachable attachment means 38 and second detachable attachment means 40 is shown. As can be seen lip portion 68 snaps beyond through aperture 60 and is retained by relief 62, thereby preventing tap 48 from inadvertently being detached and allowing side wall 24 and end wall 28 from detaching, setting up an interferance fit. However, by pushing on protrusion 52, first detachable attachment means 38 can be easily detached from second attachment means 40 to allow the box 42 to be folded back into its lay flat condition, as shown in FIG. 1. As can be seen in FIG. 10, when snapped together, the inside and outside surfaces 64 and 58, respectively of side walls 24 (and 22, not shown) have no portion of first or second detachable engagement means 38 or 40 extending there beyond, thereby forming smooth inner and outer surfaces.

Figure 11:
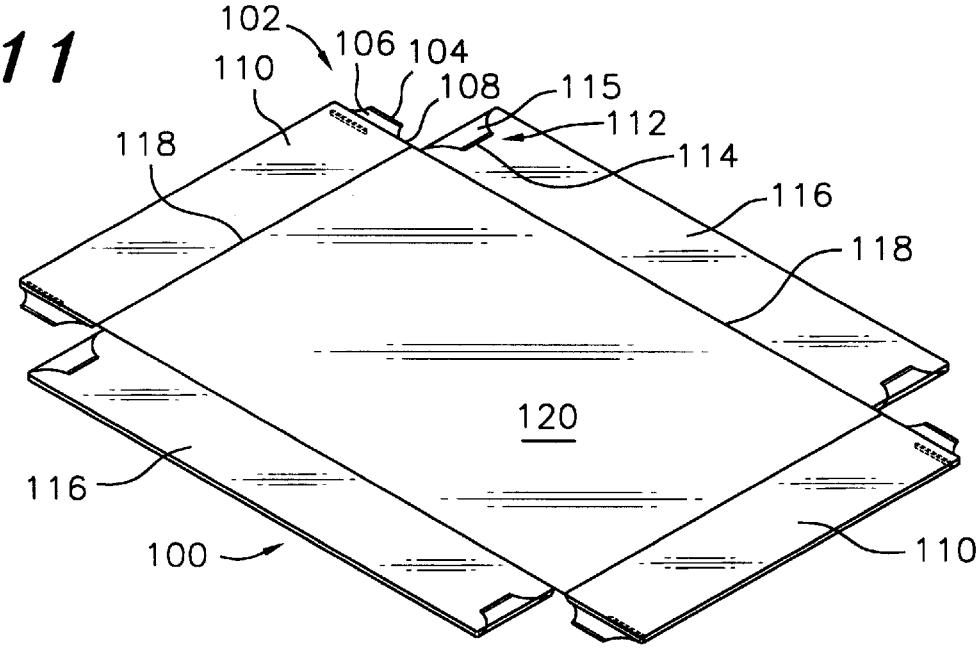
FIG. 11 a top right perspective view of a second embodiment of the folding plastic box of the invention in its unfolded state.
Figure 12:
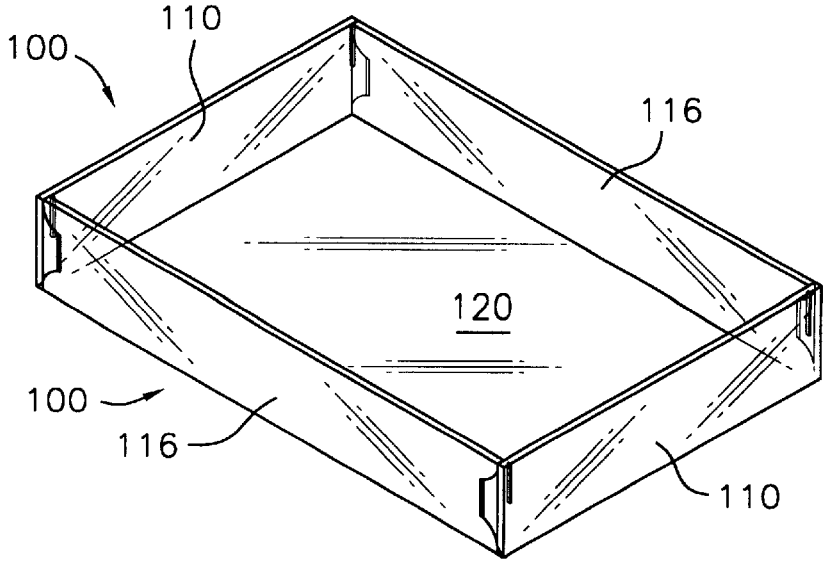
FIG. 12 is a top right perspective view of the folding plastic box of FIG. 11 that is snapped together to form an open top box.

While the first embodiment folding plastic box 10 of the invention has been described with reference to the particular first and second detachable attachment means, other types of detachable attachment means can be provided. Indeed, turning to FIGS. 11 and 12, there are shown a top right perspective view of a second embodiment of the folding plastic box 100 of the invention in its unfolded state, a top right perspective view of the folding plastic box of FIG. 11 that is snapped together to form an open top box. In the embodiment of FIGS. 11 and 12, first detachable attachment means 102 comprises an elongate protrusion 104 on tabs 106 extending from sides 108 of end walls 110, and second detachable attachment means 112, complementary to first detachable attachment means 102, comprises a slot-shaped aperture 114 and a relief 115 formed in side walls 116. The end walls 110 and side walls 116 are hingeably attached (e.g. with living hinges 118) to a bottom 120 of box 100. The slot shaped aperture 114 and relief 115 are sized to frictionally and interference fit with first detachable attachment means 102. As with the first embodiment of the foldable plastic box 100, when fit together, the side walls 116 and end walls 110 are generally smooth and free from protrusions extending beyond the confines of the walls 110 and 116.

Figure 13:
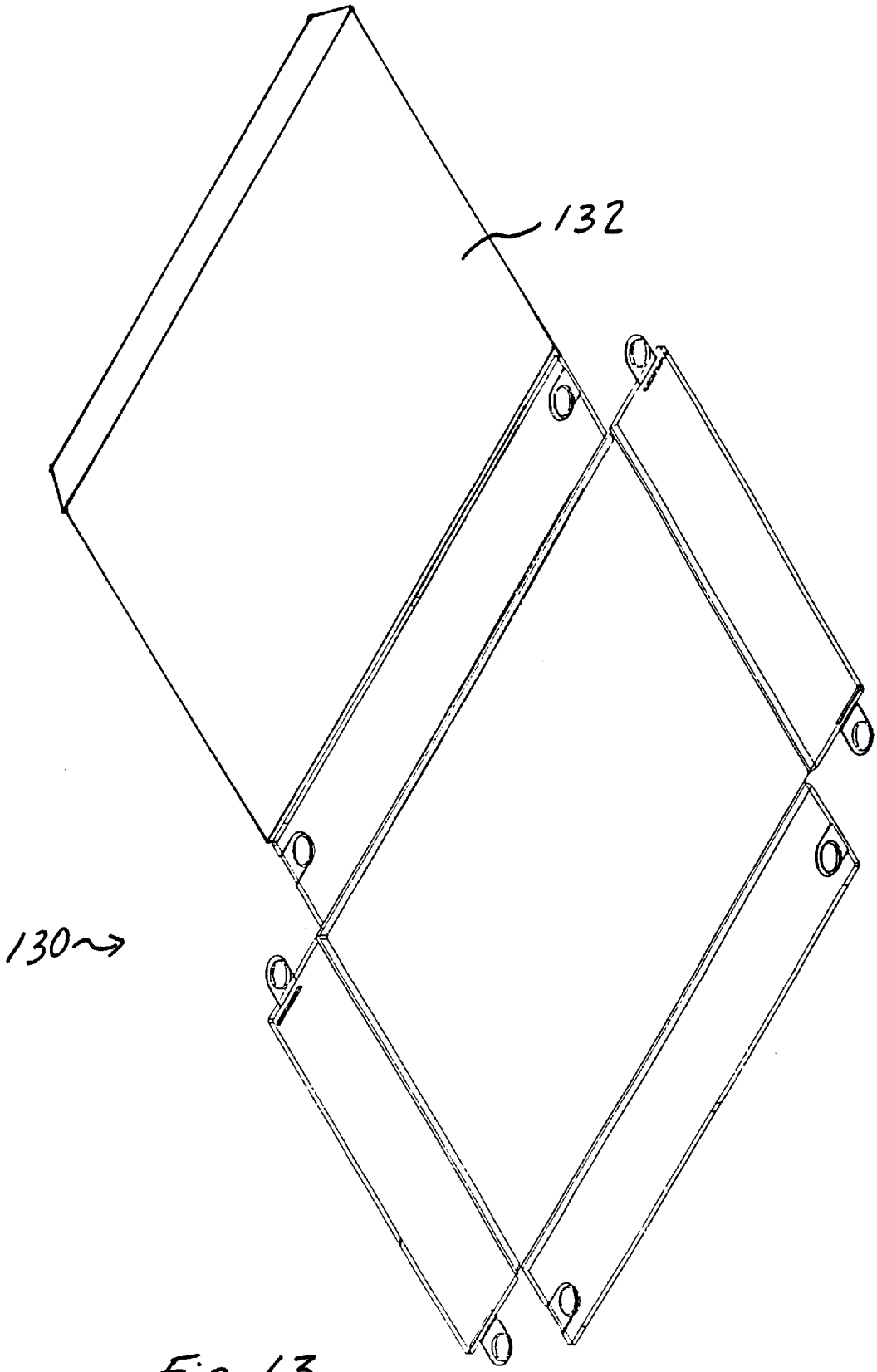
FIG. 13 is a top right perspective view of a third embodiment of the folding plastic box of the invention in its unfolded state with a closeable top.

Referring to FIG. 13, in addition to the open top boxes of FIGS. 1–12, a box 130 with a hinged and closeable top 132 can also be formed in the same manner as described above as a unitary plastic unfolded box 10.

With respect to FIGS. 1–12, the relative position of the first and second detachable attachment means 38 and 40 and 102 and 112, respectively, can be switched without changing the form or function of the boxes 42 and 100 when put together. Indeed, if desired, more than one tab 48 and a complementary number of reliefs 56 can be provided on the walls (not shown.) If the user wishes to prevent the boxes 42 and 100 so assembled from being taken apart and returned to a lay flat condition (as in FIGS. 1 and 11), a small amount of glue can be applied to the first and second detachable attachement means 38 and 40 and 102 and 112, respectively. Alternately, by making the fit between the first and second detachable attachment means very tight, the fit can be made nearly permanent, if desired. Also, while open boxes with four sides has been shown with reference to the drawings, triangular boxes or boxes with more than four sides can be made. The first detachable attachment means 38 are shown on end walls 26 and 28 and the second detachable attachment means 40 are on side walls 22 and 24. However, each side and end wall can also have one each of the first detachable attachment means 38 and second detachable attachment means 40, if desired.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

I claim:

1. A foldable plastic box, comprising: a bottom wall with a perimeter;

at least three perimeter walls hingeably affixed to the perimeter of bottom wall and having inner and outer surfaces;

a tab with a protrusion, the protrusion extending outwardly from the tab and having a perimeter with a lip portion extending from at least a portion of the perimeter of the protrusion, the tab extending from at least one side edge of at least one of the perimeter walls, and a through hole formed in at least one of the adjacent perimeter walls and a slightly larger surrounding relief formed on the inner surface of the perimeter wall, the hole and relief being sized slightly larger than the protrusion and tab and adapted to engage the tab and protrusion, wherein when the perimeter walls are brought together, the hole and relief and the tab and protrusion can be engaged together to form a box and wherein the lip portion is adapted to interference fit into the relief.

2. The foldable plastic box of claim 1, wherein the foldable plastic box is formed from a single piece of material.

3. The foldable plastic box of claim 1, wherein the perimeter walls are hingeably affixed to the perimeter of bottom wall with living hinges.

4. The foldable plastic box of claim 1, wherein the hole and relief and the tab and protrusion are detachably attachable together.

5. The foldable plastic box of claim 1, wherein when the hole and relief and the tab and protrusion are attached together, no portion of the hole and relief and tab and protrusion extends beyond inner or outer surfaces of the perimeter walls.

6. The foldable plastic box of claim 1, wherein the bottom wall is rectangular, and the perimeter walls comprise two opposed side walls with top edges and side edges, and two opposed end walls with top edges and side edges, and wherein the hole and relief are on one of the end walls and the side walls and the tab and protrusion are on the other of the end walls and side walls.

7. The foldable plastic box of claim 1, wherein the through hole is generally circular.

* * * * *